US006179135B1

(12) United States Patent
Simpson

(10) Patent No.: US 6,179,135 B1
(45) Date of Patent: Jan. 30, 2001

(54) SUPPORT ASSEMBLY FOR A STRINGED MUSICAL INSTRUMENT

(75) Inventor: Jason S. Simpson, Vista, CA (US)

(73) Assignee: Anthony A. Casillas, Escondido, CA (US)

( * ) Notice: Under 35 U.S.C. 154(b), the term of this patent shall be extended for 0 days.

(21) Appl. No.: 09/422,767

(22) Filed: Oct. 22, 1999

(51) Int. Cl.[7] ..... A47F 5/00

(52) U.S. Cl. ..... 211/85.6; 211/87.01; 211/DIG. 1; 84/327; 248/309.1; 248/206.5

(58) Field of Search ..... 211/85.6, 87.01, 211/70.6, 60.1, DIG. 1; 84/327; 248/309.1, 206.5

(56) References Cited

U.S. PATENT DOCUMENTS

D. 97,999 * 12/1935 Hamilton .
D. 305,083 * 12/1989 White .
350,523 * 10/1886 Bodley .
944,312 * 12/1909 Brede .
2,772,787 * 12/1956 Lee ..... 211/75
3,765,633 * 10/1973 Caudill .
4,176,580 * 12/1979 Gallegos ..... 84/327
4,583,647 * 4/1986 Schinzing ..... 211/60.1
5,346,073 * 9/1994 Broersma et al. ..... 211/85.6
5,375,497 * 12/1994 Pirchio et al. ..... 84/327
5,488,890 * 2/1996 Biasini ..... 84/327 X

* cited by examiner

*Primary Examiner*—Robert W. Gibson, Jr.
(74) *Attorney, Agent, or Firm*—Donn K. Harms

(57) ABSTRACT

A support device for holding guitar or other stringed instrument. The support assembly includes a base for mounting on a structure such as a wall or an amplifier. A bracket extends from the base and has an opening for receiving an instrument neck. The opening has an entrance through which the side of the neck enters. An entrance ramp guides the neck into the opening and a finger extending slightly into the entrance opposite the ramp restricts inadvertent withdrawal of the neck from the opening. In one embodiment, several such openings are provided along a member that can be fastened to a wall. Another embodiment has a single opening, with a strong permanent magnet opposite the opening to hold the device to a magnetic metal structure such as an amplifier.

18 Claims, 1 Drawing Sheet

SUPPORT ASSEMBLY FOR A STRINGED MUSICAL INSTRUMENT

FIELD OF THE INVENTION

This invention relates to stands, clips and other supports for holding a stringed musical instrument, such as a guitar, when not being played, to protect the instrument against falling and resulting damage.

BACKGROUND OF THE INVENTION

Stringed instruments, such as guitars, are fragile and must be protected against damage when not in use. Often, it is not convenient to return the instrument to an enclosing case during break in playing and the like. Also, a musician may use several different instruments, switching between them during a performance.

A number of different stands, clamps, etc., have been developed to support a stringed instrument when not in use. They tend to provide insufficient support for the instrument and to be large and complex and difficult to store and transport.

Typical of the prior art supports is the stand described by Broersma et al. in U.S. Pat. No. 5,346,073. A flat sheet of plastic material having recesses for receiving a stringed instrument neck and a weighted extension for placing on an adjacent amplifier. The recesses, however, do not retain the neck against being jarred from the recess and falling to the floor if the instrument or amplifier is bumped. Further, simply relying on the weight of the stand to keep it from sliding off of the amplifier if the amplifier or stand is bumped is not satisfactory.

Caudill, in U.S. Pat. No. 3,765,633 describes a claw-like receiver for a stringed instrument neck, with the receiver mounted on a large clamp mechanism that extends entirely across the top of an amplifier or speaker. The arms of the receiver must be pushed apart to receive wide instrument necks and, if inadvertently releases during neck insertion or withdrawal could damage the neck or strings thereon. The clamping mechanism is large and cumbersome and would be difficult to store and transport when not in use. The clamping mechanism would only fit an amplifier and the like that have two opposite surfaces the necessary distance apart and that did not have controls or the like that would be covered by the large clamp.

Cuccio, in U.S. Pat. No. 4,546,688, describes a holder for stringed instruments that comprises a curved cradle against which the instrument is leaned. The cradle is mounted on a prong for insertion into an electrical receptacle jack. The shallow cradle would not protect the instrument in the case of a slight impact against either the instrument or the amplifier. Further the prong would require an unused jack of the required size and would be likely to rotate in the jack and allow the instrument to fall.

Smith, in U.S. Pat. No. 5,313,866, describes an elaborate, large and relatively heavy stand for a guitar having a U-shaped bracket from which the guitar is hung, mounted on a wide and long clamp mechanism extending from front to back across an amplifier or the like. The bracket will not protect the guitar against a bump in the direction of the U-shaped opening. Since the guitar is suspended, falling from the bracket could cause significant damage. The entire assembly is very large and would be very inconvenient to store and transport. Further, the bracket may cover or obstruct controls on many amplifiers.

Harkey, in U.S. Pat. No. 4,991,809, describes a simple U-shaped bracket for supporting the neck of a stringed musical instrument, with the bracket mounted on a clamp mechanism that extends across the upper surface of an amplifier, with the clamp held in place by spring forces. Any slight impact against the neck of the instrument in the direction of the bracket opening would cause the instrument to fall and possibly be damaged. The clamping device is large and would be difficult to store between uses and may obstruct amplifier controls.

Thus, there is a continuing need for improved devices for supporting stringed instruments, such as guitars, when not being played, that provide protection against the instrument falling out of the device, that are quickly and easily connected to a support structure such as an amplifier, that provide a firm connection to the support that will resist being knocked loose by inadvertent contact, and that are small and compact so as to be storable and transportable in the instrument case.

SUMMARY OF THE INVENTION

The above-noted problems, and others, are overcome by the support device of this invention that basically comprises a member having opposed surfaces, means for mounting the device on a support structure, such as an amplifier or speaker, with an end extending away from the support structure having at least one of the surfaces horizontal and an opening extending into a side of the device.

The opening has an entrance into an area preferably having a generally straight side towards the end of the device, with a short finger extending into the entrance, a short straight ramp narrowing the entrance opposite the finger and a curved (optimally elliptical) surface opposite the straight side.

In one embodiment, a plurality of openings are provided along the length of the member spaced so that a corresponding plurality of stringed instruments can be supported. The openings are formed in an elongated member secured to a base. The base may be secured to a wall or the like by fasteners, such as screws, bolts or the like, to semi-permanently secure the base and member to a wall or the like with all of the openings horizontal. The member may be formed of any suitable material, including wood, molded plastic, non-magnetic metal, etc. For light weight and excellent appearance, wood is preferred.

In a second embodiment, the member has a single opening at one end and a base at the other end. High strength permanent magnets, preferably neodymium magnets, are secured to the base, preferably adhesively bonded within a pocket in the base. Preferably, an aperture between the base and the opening houses conventional batteries and electrical circuitry, with a lamp extending through the member at a predetermined location, with a manually operated switch on the member, to be operated to illuminate the member to aid in inserting or removing a stringed instruments where light levels are low. The batteries may be rechargeable and a connector may be mounted on the member for connection to a conventional recharger.

While the member of the second embodiment may be formed from any suitable material, such as a non-magnetic material, molded plastic and the like, aluminum is preferred for light weight, non-magnetic properties and ease of manufacture.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
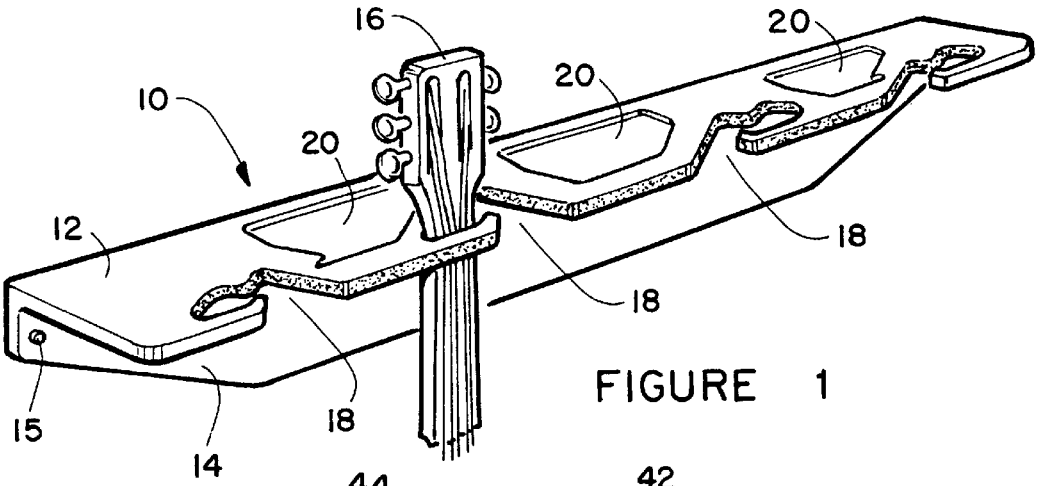
FIG. 1 is a perspective view of a first embodiment having multiple openings for supporting stringed instruments.
Figure 6:
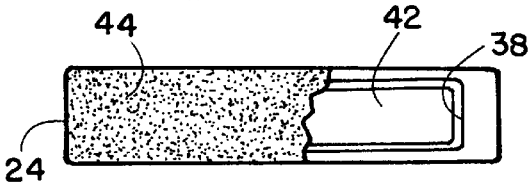
FIG. 6 is a rear elevation view, partially cut-away, of the embodiment of FIG. 2.
Figure 4:
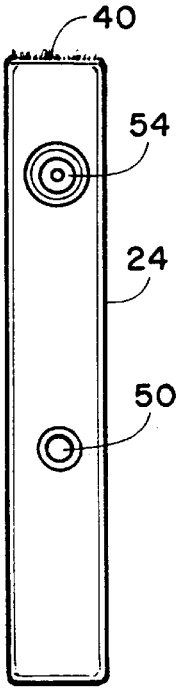
FIG. 4 is a left side view of the embodiment of FIG. 2.

Referring to FIG. 1, there is seen a support assembly 10 for supporting a plurality of stringed instruments 12, one of which is partially shown. Assembly 10 includes an elongated support device 12 with a base 14 secured thereto by any suitable means, such as screws 15. Generally, the conventional body end (not shown) of instrument 12 will rest on the floor, although the instrument could hang from support member 10, if desired. Any suitable stringed instrument can be supported by assembly 10. While any suitable material may be used for assembly 10, wood is preferred for light weight, excellent appearance and ease of manufacture. The proximal edge of support device 12 may be fastened to base 14 in any suitable manner, such as adhesives, screws, etc. Similarly, support assembly 10 may be fastened to a wall or other structure in any suitable manner with screws or bolts preferred for easy installation and removal of the support assembly.

Figure 2:
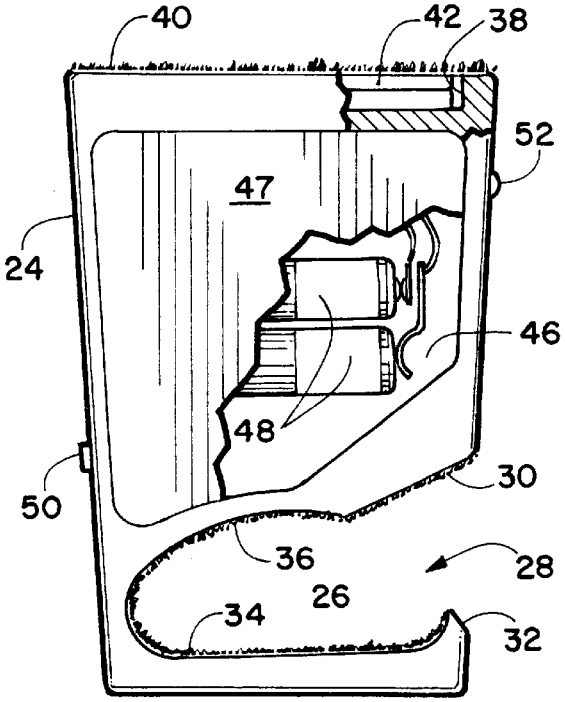
FIG. 2 is a plan view, partially cut-away, of a second embodiment, for supporting a single stringed instrument.
Figure 5:
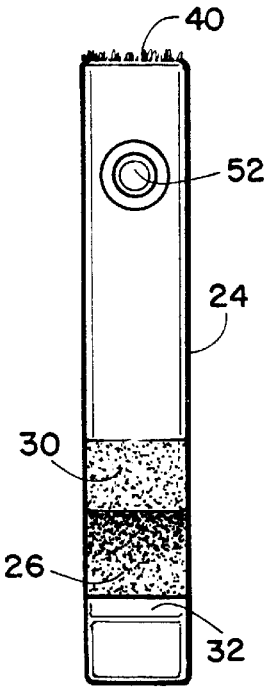
FIG. 5 is a right side view of the embodiment of FIG. 2.
Figure 3:
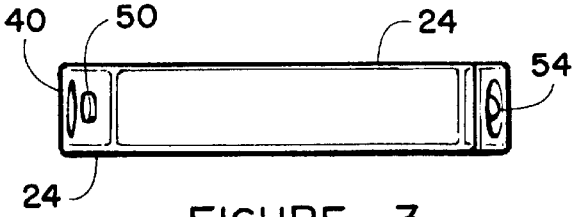
FIG. 3 is a front elevation view of the embodiment of FIG. 2.

A plurality of openings 18 are provided along the distal edge of support device 12, spaced apart a distance suitable for the instruments to be supported. These openings 18 are the same as that shown in greater detail in FIG. 2. Apertures 20 may be provided though support device 12 if desired, to reduce weight and improve appearance.

FIGS. 2–6 show details of a second embodiment of the support assembly. Support device 24 preferably has two, generally parallel, flat opposed sides that, in use, will be upper and lower sides. A support opening 26 has an entrance 28 from one side. Depending on which side of support device 24 is positioned upwardly, entrance 28 could enter from either side. A ramp 30 is provided on one side of entrance 28 to guide the neck of a stringed instrument into opening 26. Opposite ramp 30 a short finger 32 extends into opening 28 to help hold the instrument in place. Opening 28 is defined by a generally flat side 34 toward the distal end of the device and a concave, preferably generally elliptical, side 36 opposite flat side 34.

As an instrument neck is inserted through entrance 28, it will be tilted slightly to follow ramp 30. Once fully inserted, the neck will be rotated slightly to bring it to approximately parallel to flat side 34. Then, finger 32 will prevent the instrument neck from sliding along flat surface 34 and out of entrance 28. To remove the instrument, the neck is rotated slightly to slide out along ramp 30. This configuration of opening 28 provides optimum ease of insertion and removal while providing optimum retention. Preferably ramp 30, finger 32, and the entire surface of opening 26 is lined with soft material, such as felt, to avoid scratching or otherwise damaging an instrument neck.

A pocket 38 is provided across base, proximal, end 40 of device 24. One or more high strength permanent magnets 42 are secured in pocket 38, such as by adhesive bonding. A sheet 44 of flexible material such as felt or rubber sheet is preferably bonded over pocket 38 to help resist sliding of the device on a magnetic metal surface to which it is secured by magnet 42. Optimally, sheet 44 will be formed of conventional rubber containing permanent magnet particles to enhance attraction of the device to a metal surface. Device 24 thus can be positioned in any suitable position on any surface formed from a magnetic metal, such as the conventional steel housings for amplifiers.

Often, the stage area during performances will have dark areas with little illumination. This, combined with localized spotlights, may clearly make seeing the support device 24 when a performer wishes to change instruments. Therefore, an illumination system is preferably provided. Between pocket 38 in base 40 and opening 26 an aperture or recess 46 is preferably provided. Conventional batteries 48 and wiring are contained within pocket 38, connected in a conventional manner to a push button, momentarily on, switch 50 and then to a lamp 52. Lamp 52 may be installed in a corresponding hole at any desired location in support device 24. Batteries 48 may be rechargeable. If so, a conventional connector 54 may be provided for connecting the batteries to a conventional charging unit (not shown).

Covers 47 may be applied to one or both surfaces of support device 24 to close aperture 46. Typically thin sheets of plastic, wood veneer, etc., may be bonded to the support device or to the battery pack. Alternatively, if desired, one cover may be hinged or snapped into recesses around aperture 46 in a conventional manner to provide access for changing batteries.

While certain specific relationships, materials and other parameters have been detailed in the above description of preferred embodiments, those can be varied, where suitable, with similar results. Other applications, variation and ramifications of the present invention will occur to those skilled in the art upon reading the present disclosure. Those are intended to be included within the scope of this invention as defined in the appended claims.

I claim:

1. A support assembly for a stringed musical instrument which comprises:

a base for mounting on a generally vertical surface;

a pocket in said base;

a bracket extending from said base and positionable generally horizontally;

a permanent magnet in said pocket for magnetically adhering said bracket to a magnetic metal structure;

at least one opening in said bracket;

a substantially straight side on said opening away from said base, a concave curved opening side toward said base;

a side entrance into said opening for insertion of a stringed instrument neck through said side entrance into said opening;

and a finger partially closing said side entrance to allow insertion of said stringed instrument neck while restricting inadvertent movement of said neck out of said opening.

2. The support system according to claim 1, further including a ramp along said entrance for guiding said neck into said opening.

3. The support system according to claim 1, including a plurality of said openings linearly arranged along said bracket.

4. The support system according to claim 1, further including an aperture in said bracket between said base and said opening, said aperture adapted to hold a battery means, a lamp associated with said bracket and switch means for connecting said battery means to said lamp to illuminate an area around said opening.

5. The support system according to claim 4 wherein said battery means includes a rechargeable battery and further including connection means on said bracket for connection to a battery recharging system.

6. A support assembly for a stringed musical instrument which comprises:

a generally flat base having a pocket therein;

a permanent magnet mounted in said pocket for securing said base to a magnetic metal surface;

a bracket extending from said base;

an opening in said bracket sized to receive the neck of a stringed musical instrument;

an entrance through said bracket communicating with said opening for insertion of said neck into said opening;

guide means for guiding a stringed instrument neck into and out of said opening;

retention means for restricting inadvertent withdrawal of said neck from said opening.

7. The support assembly according to claim 6 wherein said opening has a generally flat surface on a side away from said base and a concave curved surface on a side toward said base.

8. The support assembly according to claim 6 wherein said concave curved surface is approximately a portion of an ellipse.

9. The support assembly according to claim 6 wherein said guide means is a ramp on a first side of said entrance and said retention means is a finger extending partially into said entrance opposite said ramp.

10. The support assembly according to claim 6 further including a layer of soft material over all opening surfaces.

11. The support system according to claim 6, further including an aperture in said bracket between said base and said opening, said aperture adapted to hold a battery means, a lamp associated with said bracket and switch means for connecting said battery means to said lamp to illuminate an area around said opening.

12. The support system according to claim 11 wherein said battery means includes a rechargeable battery and further including connection means on said bracket for connection to a battery recharging system.

13. The support assembly according to claim 11, further including a sheet of slip resistant material over said base.

14. The support assembly according to claim 12 wherein said sheet is formed from rubber material having magnet particles dispersed therethrough.

15. A support assembly for a plurality of stringed musical instruments which comprises;

an elongated base member;

fastening means for fastening said elongated base member to a structure;

an elongated bracket secured along a proximal edge to said base member and having a distal edge extending away therefrom;

a plurality of spaced openings in said bracket lying approximately parallel to said distal edge;

each said opening having a generally flat surface on a side away from said base and a concave curved surface on a side toward said base;

an entrance between said distal edge and said openings for receiving a stringed instrument neck;

guide means along said entrance for guiding a said neck through said entrance into and out of said opening: and retention means for restricting inadvertent withdrawal of said neck from said opening through said entrance.

16. The support assembly according to claim 15 wherein each said concave curved surface is approximately a portion of an ellipse.

17. A support assembly for a plurality of stringed musical instruments which comprises;

an elongated base member;

fastening means for fastening said elongated base member to a structure;

an elongated bracket secured along a proximal edge to said base member and having a distal edge extending away therefrom;

a plurality of spaced openings in said bracket lying approximately parallel to said distal edge;

an entrance between said distal edge and said openings for receiving a stringed instrument neck;

guide means along said entrance for guiding a said neck through said entrance into and out of said opening;

said guide means comprising a ramp on a first side of said entrance;

retention means for restricting inadvertent withdrawal of said neck from said opening through said entrance; and said retention means comprising a finger extending partially into said entrance opposite said ramp.

18. The support assembly according to claim 17 further including a layer of soft material over opening, entrance, ramp and finger surfaces.

* * * * *